US009520116B2

(12) United States Patent
Hummel

(10) Patent No.: US 9,520,116 B2
(45) Date of Patent: Dec. 13, 2016

(54) UNIVERSAL EFFECTS CARRIER

(71) Applicant: Markus Oliver Hummel, Los Altos Hills, CA (US)

(72) Inventor: Markus Oliver Hummel, Los Altos Hills, CA (US)

( * ) Notice: Subject to any disclaimer, the term of this patent is extended or adjusted under 35 U.S.C. 154(b) by 0 days.

(21) Appl. No.: 15/137,720

(22) Filed: Apr. 25, 2016

(65) Prior Publication Data

US 2016/0240178 A1 Aug. 18, 2016

Related U.S. Application Data

(63) Continuation-in-part of application No. 15/134,777, filed on Apr. 21, 2016, which is a continuation of application No. 14/629,692, filed on Feb. 24, 2015, now Pat. No. 9,349,360, which is a continuation-in-part of application No. 14/073,689, filed on Nov. 6, 2013, now Pat. No. 9,012,759, application No. 15/137,720, which is a continuation-in-part of application No. 15/045,637, (Continued)

(51) Int. Cl.

| | |
|---|---|
| ***G10H 1/32*** | (2006.01) |
| ***G10H 3/00*** | (2006.01) |
| ***G10H 1/02*** | (2006.01) |
| ***G10H 1/00*** | (2006.01) |
| ***G10H 3/18*** | (2006.01) |
| ***H04R 1/02*** | (2006.01) |

(52) U.S. Cl.

CPC ..... *G10H 1/02* (2013.01); *G10H 1/0033* (2013.01); *G10H 1/0091* (2013.01); *G10H 1/32* (2013.01); *G10H 3/186* (2013.01); *H04R 1/028* (2013.01); *G10H 2210/231* (2013.01); *G10H 2220/391* (2013.01); *G10H 2220/395* (2013.01); *G10H 2240/165* (2013.01)

(58) Field of Classification Search

CPC ..... G10H 3/00; G10H 1/0091; G10H 1/02; G10H 1/32; G10H 1/342; G10H 3/186; G10H 1/0033; G10H 1/028; G10H 2210/231; G10H 2220/391; G10H 2220/395

USPC ..... 84/737, 743, 746

See application file for complete search history.

(56) References Cited

U.S. PATENT DOCUMENTS 4,509,190 A * 4/1985 Spector ..... H04R 3/12 381/119

5,637,823 A * 6/1997 Dodge ..... G10H 1/32 84/726

(Continued)

*Primary Examiner* — Jeffrey Donels

(57) ABSTRACT

A universal effects carrier for use with electric instruments that allows for reduced or eliminated signal loss before the electronic signal of the instrument is passed through an effects pedal. A mounting cartridge includes a first receiving slot and a second receiving slot for retaining a primary effects pedal and a secondary effects pedal; the primary effects pedal and the secondary effects pedal being electrically connected to a signal-in port and a signal-out port via a signal-in pedal connector and a signal-out pedal connector. The primary effects pedal and the secondary effects pedal are further electrically connected by a bridge cable. The mounting cartridge is attached to an electric instrument through a cartridge receiver; the cartridge receiver including a signal-in terminal to be electrically connected to the signal-in port and a signal-out terminal to be electrically connected to the signal-out port.

12 Claims, 12 Drawing Sheets

Related U.S. Application Data filed on Feb. 17, 2016, now Pat. No. 9,373,315, which is a continuation-in-part of application No. 14/632,521, filed on Feb. 26, 2015, now Pat. No. 9,293,125, which is a continuation of application No. 14/073,689, filed on Nov. 6, 2013, now Pat. No. 9,012,759.

(60) Provisional application No. 62/152,373, filed on Apr. 24, 2015, provisional application No. 61/946,450, filed on Feb. 28, 2014, provisional application No. 61/948,448, filed on Mar. 5, 2014, provisional application No. 61/724,106, filed on Nov. 8, 2012.

(56) References Cited

U.S. PATENT DOCUMENTS 5,767,432 A * 6/1998 Randolph ..... G10D 1/085 84/267
6,075,194 A * 6/2000 Marinic ..... G10H 1/10 84/600
6,150,947 A * 11/2000 Shima ..... A63H 5/00 340/692
6,376,761 B1 * 4/2002 LaMarra ..... G10H 1/02 381/118
7,326,849 B2 * 2/2008 Adams ..... G10H 1/0066 84/743
7,711,442 B2 * 5/2010 Ryle ..... G10H 3/186 700/94
7,786,371 B1 * 8/2010 Moates ..... G10H 1/0066 84/464 R
7,838,758 B2 * 11/2010 Van Ekstrom ..... G10H 3/183 84/726
8,075,342 B1 * 12/2011 Harney ..... G10H 3/186 439/620.01
8,609,972 B2 * 12/2013 Harada ..... G10H 1/0008 84/626
8,642,876 B2 * 2/2014 DeRoche ..... G10H 3/18 84/723
2002/0065568 A1 * 5/2002 Silfvast ..... G10H 1/0058 700/94
2003/0041721 A1 * 3/2003 Nishitani ..... G10H 1/00 84/609
2003/0196542 A1 * 10/2003 Harrison, Jr. ..... G04B 25/00 84/737
2006/0272489 A1 * 12/2006 Remignanti ..... G10H 1/0091 84/723
2007/0169615 A1 * 7/2007 Chidlaw ..... G10H 1/0091 84/723
2014/0090547 A1 * 4/2014 Udell, III ..... G10H 1/0091 84/626

* cited by examiner

UNIVERSAL EFFECTS CARRIER

The current application claims benefit of U.S. Provisional Patent Application Ser. No. 62/152,373 filed on Apr. 24, 2015.

The current application is further a continuation in part of U.S. Utility patent application Ser. No. 15/134,777 filed on Apr. 21, 2016 which is a continuation of U.S. Utility patent application Ser. No. 14/629,692 filed on Feb. 24, 2015 which claims benefit to U.S. Provisional Patent Application Ser. No. 61/946,450 filed on Feb. 28, 2014, claims benefit to U.S. Provisional Patent Application Ser. No. 61/948,448 filed on Mar. 5, 2014, and is a continuation in part of U.S. Utility patent application Ser. No. 14/073,689 filed on Nov. 6, 2013 which claims benefit to U.S. Provisional Patent Application Ser. No. 61/724,106 filed on Nov. 8, 2012.

The current application is further a continuation in part of U.S. Utility patent application Ser. No. 15/045,637 filed on Feb. 17, 2016 which is a continuation in part of U.S. Utility patent application Ser. No. 14/632,521 filed on Feb. 26, 2015 which is a continuation of U.S. Utility patent application Ser. No. 14/073,689 filed on Nov. 6, 2013 which claims benefit to U.S. Provisional Patent Application Ser. No. 61/724,106 filed on Nov. 8, 2012.

FIELD OF THE INVENTION

The present invention relates generally to instrument tone effects. More specifically, the present invention integrates an existing effects pedal into the body of an electric instrument in order to reduce signal loss before the electronic signal of an electric instrument is passed through the effects pedal.

BACKGROUND OF THE INVENTION

In the music industry, it has often been desirable to alter the sound produced from a musical instrument using sound effects. Sound effects were originally produced using techniques such as manipulating reel-to-reel tape after recording or through microphone placement during recording. As such, early sound effects were limited to in studio productions. The ability for individual musicians to manipulate instrument sounds in-home became available with the emergence of sound effects modules. Sound effects modules are electronic devices that allow musicians to manipulate the sound produced from an electric or electronic instrument. Earlier stand-alone sound effects modules were impractical as the equipment was both bulky and costly. Thus, the first practical sound effects modules to be used regularly outside of the studio were those built into amplifiers using vacuum tubes. With the emergence of the electronic transistor, sound amplification circuitry was able to be even further condensed into small, portable containers commonly referred to as stompbox units. Stompbox units can be designed to produce one or more effects and typically provide a number of controls for adjusting the extent to which the sound of the instrument is manipulated.

While sound effects modules are used with many different types of musical instruments, sound effects modules are most notably used in conjunction with electric guitars in the form of stompboxes. One issue with the use of stompboxes with electric guitars is cable signal loss, which is due, at least in part, to the length of the guitar cable that is used between the guitar and the stompboxes. The cable signal loss across the guitar cable between where the electronic signal of the guitar is generated to where the sound effect is applied results in a loss in tone, which is undesirable to most musicians. Ideally, tone effects are applied as close to the signal generation as possible in order to reduce the amount of signal loss that occurs before the effect is applied. Another issue associated with stompboxes is their accessibility. Stompboxes are typically either placed at the feet of the user or mounted together on a rack. Thus, in order for a musician to adjust the effects controls they must do so with their feet or be within an arm's reach of the rack. Resultantly, effects controls are typically adjusted before a set or an individual song and are not altered throughout.

Therefore it is an object of the present invention to provide a universal effects carrier that is integrated into the body of an electric instrument for easy access and manipulation of controls of an effects pedal and reduction in signal loss before applied effects. A cartridge receiver is integrated into the body of the instrument, while a mounting cartridge used for securing the effects pedal is attached to the instrument via the cartridge receiver. Signal loss between signal generation and the applied sound effect is reduced or altogether eliminated as the cartridge receiver is mounted directly onto the electric instrument, thus reducing the length of wire that the generated electronic signal must traverse in order to reach the effects pedal. Together, the cartridge receiver and the mounting cartridge provide electronic connections between the electric instrument and the effects pedal.

DETAIL DESCRIPTIONS OF THE INVENTION

All illustrations of the drawings are for the purpose of describing selected versions of the present invention and are not intended to limit the scope of the present invention.

The present invention is a universal effects carrier for use with electric instruments that allows for reduced or eliminated signal loss before the electronic signal of the instrument is passed through an effects pedal. The present invention allows any existing stompbox effect/effects pedal to be attached to an instrument and be more closely integrated with the electronics of the instrument. While the present invention is intended for use with electric guitars, the universal effects carrier can be used with any other electric instrument 5. In the preferred embodiment of the present invention, the universal effects carrier is designed to be retrofitted to an existing instrument; however, the universal effects carrier may be integrated into new instruments at the time of manufacture if so desired.

The universal effects carrier comprises a mounting cartridge 2 and a cartridge receiver 1. The cartridge receiver 1 is attached to an electric instrument 5 and serves as a docking station for the mounting cartridge 2. At least one effects pedal is attached to the mounting cartridge 2 and allows the user to readily manipulate the electronic signal of the electric instrument 5. Signal loss between where the electronic signal is generated and where the sound effect is applied is significantly reduced as a result of the effects pedal being closely wired to where the electronic signal is generated within the electric instrument 5. The mounting cartridge 2 is removably attached to the cartridge receiver 1 such that the mounting cartridge 2 can be removed for maintenance or replaced. In the preferred embodiment of the present invention, the cartridge receiver 1 is mounted externally on the desired electric instrument 5; however, it is also possible for the cartridge receiver 1 to be mounted to the desired electric instrument 5 internally.

Figure 1:
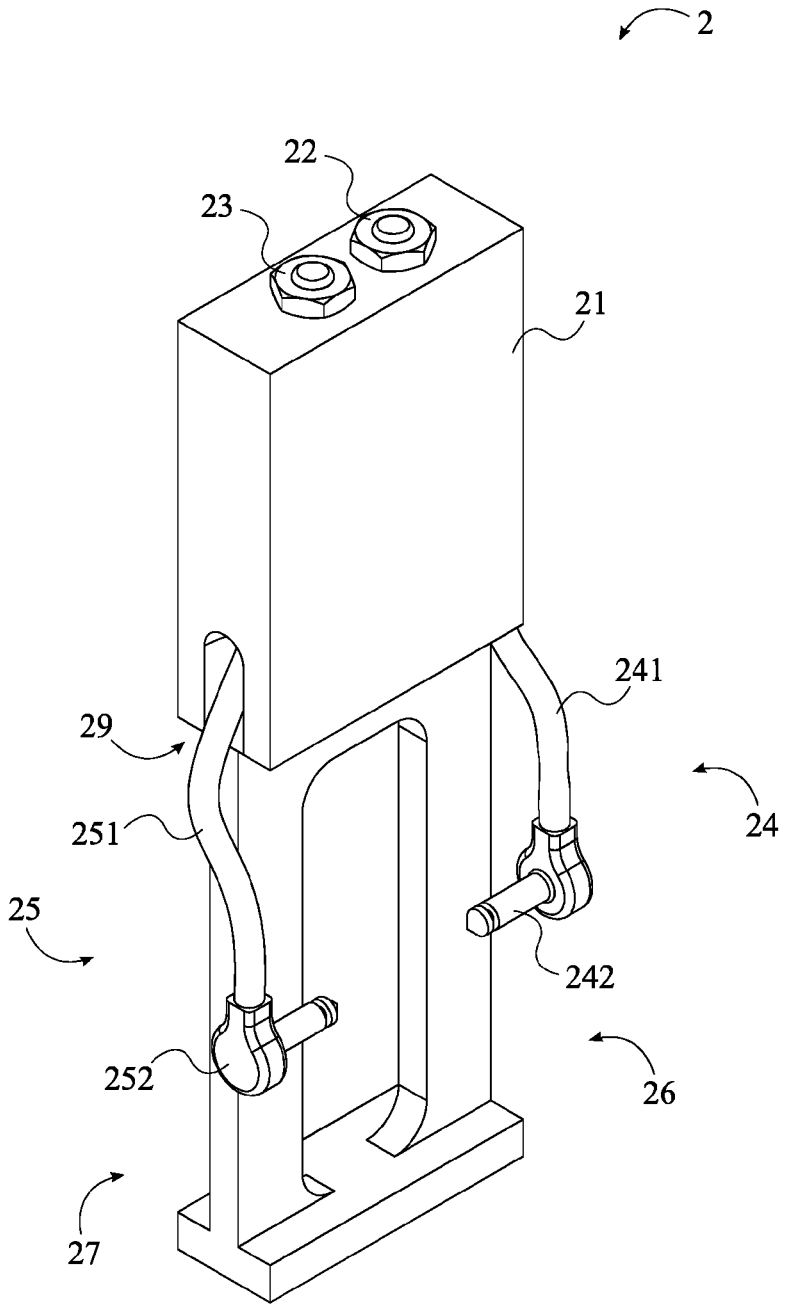
FIG. 1 is a perspective view of the mounting cartridge of the universal effects carrier.
Figure 2:
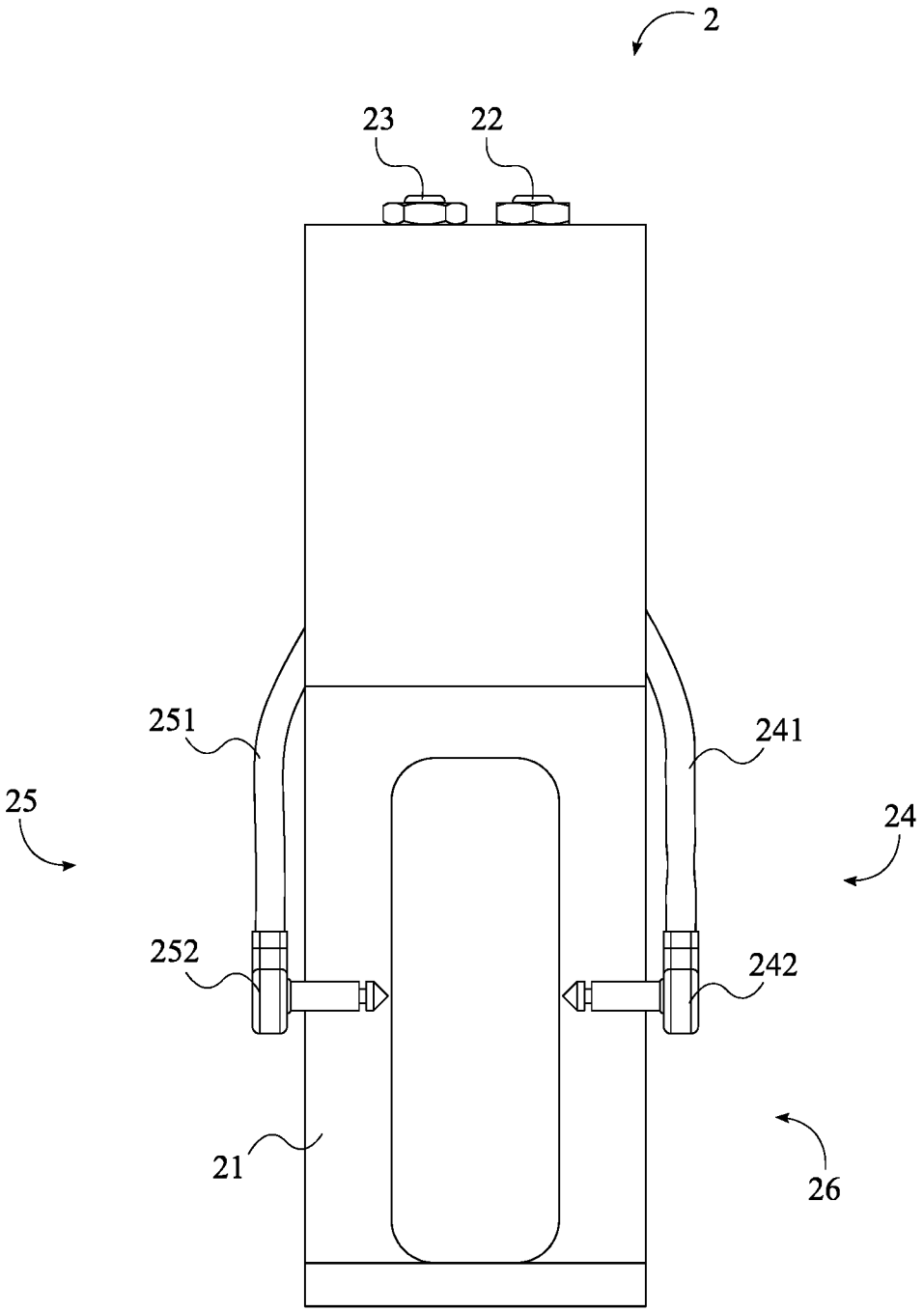
FIG. 2 is a front elevational view of the mounting cartridge.
Figure 3:
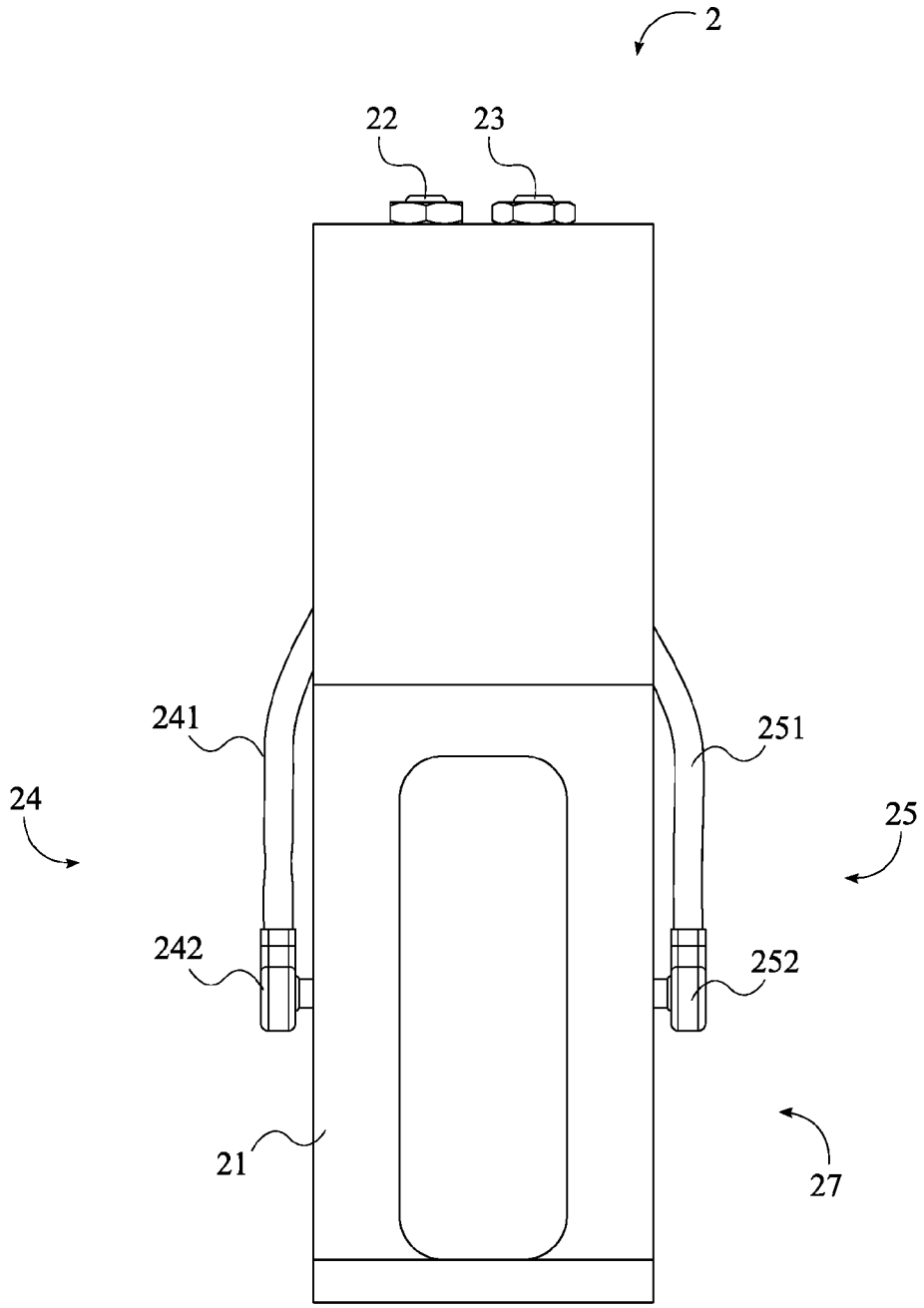
FIG. 3 is a rear elevational view of the mounting cartridge.

In reference to FIG. 1-3, the mounting cartridge 2 comprises a cartridge casing 21, a signal-in port 22, a signal-out port 23, a signal-in pedal connector 24, a signal-out pedal connector 25, a first receiving slot 26, and a second receiving slot 27. The cartridge casing 21 is a structure that provides a mounting frame for the signal-in port 22, the signal-out port 23, the signal-in pedal connector 24, and the signal-out pedal connector 25. The signal-in port 22 and the signal-out port 23 are positioned adjacent to each other through the top side of the cartridge casing 21 and are both connected to the cartridge casing 21. The mounting cartridge 2 is electronically connected to the cartridge receiver 1 through the signal-in port 22 and the signal-out port 23. Additionally, the signal-in port 22 and the signal-out port 23 are electronically connected to the signal-in pedal connector 24 and the signal-out pedal connector 25 respectively.

Figure 4:
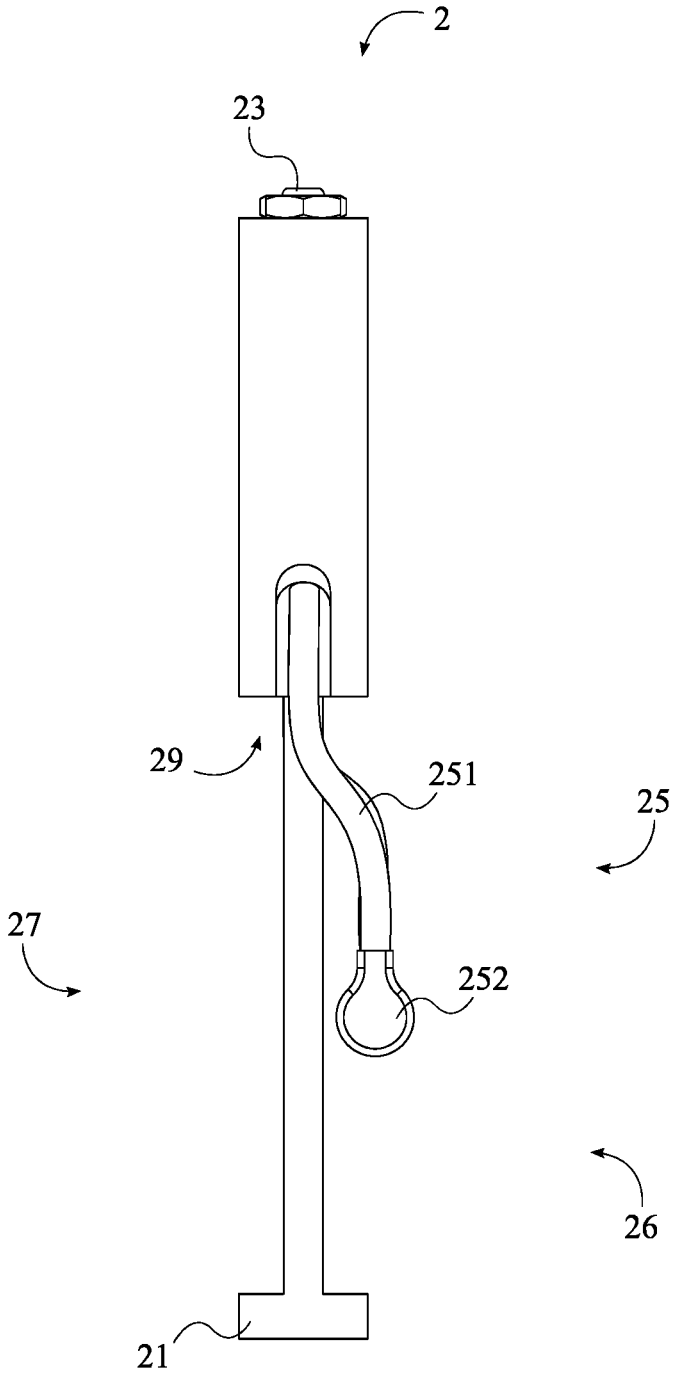
FIG. 4 is a left side elevational view of the mounting cartridge.
Figure 5:
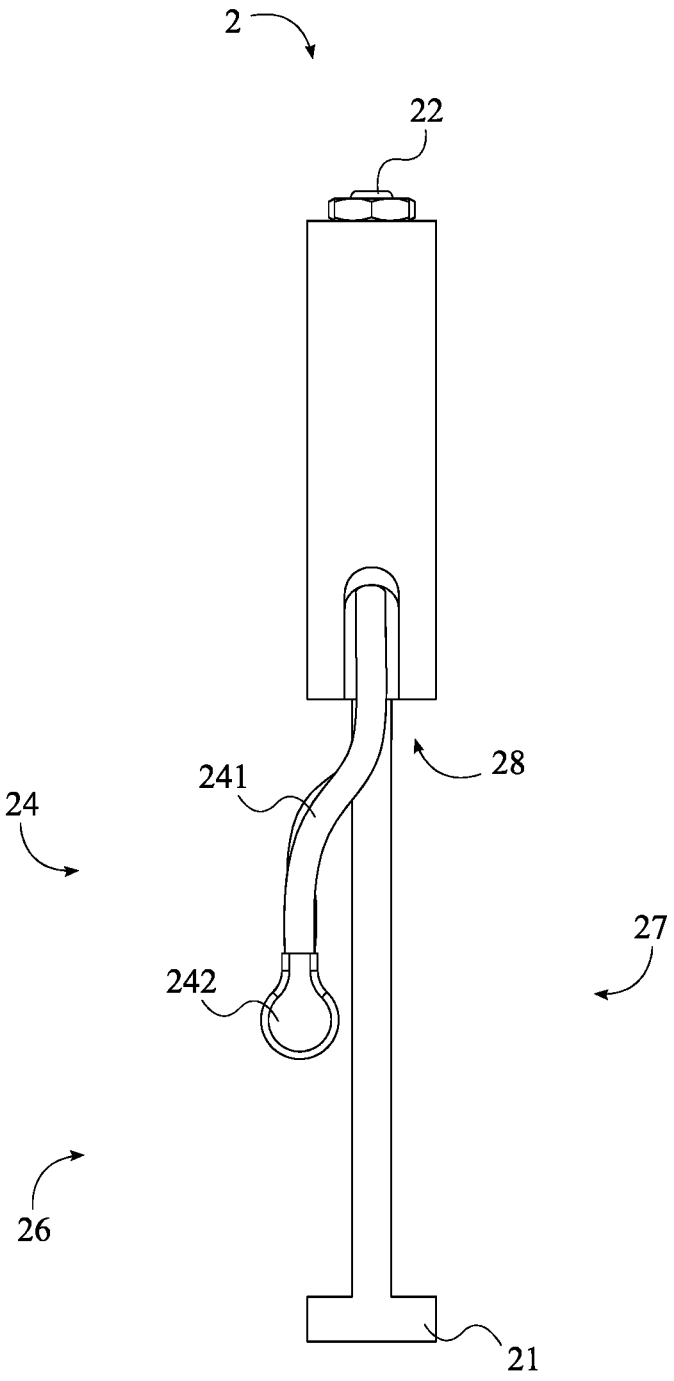
FIG. 5 is a right side elevational view of the mounting cartridge.

In reference to FIG. 4-5, the first receiving slot 26 and the second receiving slot 27 each provide a means for mounting an effects pedal to the cartridge casing 21. The first receiving slot 26 traverses into the cartridge casing 21 and is positioned along the cartridge casing 21 opposite the signal-in port 22 and the signal-out port 23. Similarly, the second receiving slot 27 traverses into the cartridge casing 21 opposite the first receiving slot 26, and is positioned along the cartridge casing 21 opposite the signal-in port 22 and the signal-out port 23. The first receiving slot 26 and the second receiving slot 27 are positioned opposite each other about the cartridge casing 21, such that an effects pedal can be attached to the front and the back of the cartridge casing 21.

Both the signal-in pedal connector 24 and the signal-out pedal connector 25 are pivotally connected to the cartridge casing 21 such that the signal-in pedal connector 24 and the signal-out pedal connector 25 can be adjusted in order to insert an effects pedal into the first receiving slot 26 and the second receiving slot 27. The signal-in pedal connector 24 comprises a signal-in cable 241 and a signal-in jack 242; the signal-in cable 241 being pivotally connected to the cartridge casing 21 and the signal-in jack 242 being terminally connected to the signal-in cable 241 opposite the cartridge casing 21. Similarly, the signal-out pedal connector 25 comprises a signal-out cable 251 and a signal-out jack 252; the signal-out cable 251 being pivotally connected to the cartridge casing 21 and the signal-out jack 252 being terminally connected to the signal-out cable 251 opposite the cartridge casing 21.

The signal-in cable 241 provides the electrical wiring that electrically connects the signal-in jack 242 to the signal-in port 22. Similarly, the signal-out cable 251 provides the electrical wiring that electrically connects the signal-out jack 252 to the signal-out port 23. The electrical wiring of the signal-in cable 241 and the signal-out cable 251 is enclosed in a protective casing that is flexible to allow the signal-in cable 241 and the signal-out cable 251 to be pivoted about the sides of the cartridge casing 21. The signal-in pedal connector 24 and the signal-out pedal connector 25 are positioned opposite each other across the cartridge casing 21 in order to accommodate the standard port placement on effects pedals, as shown in FIG. 8.

Figure 7:
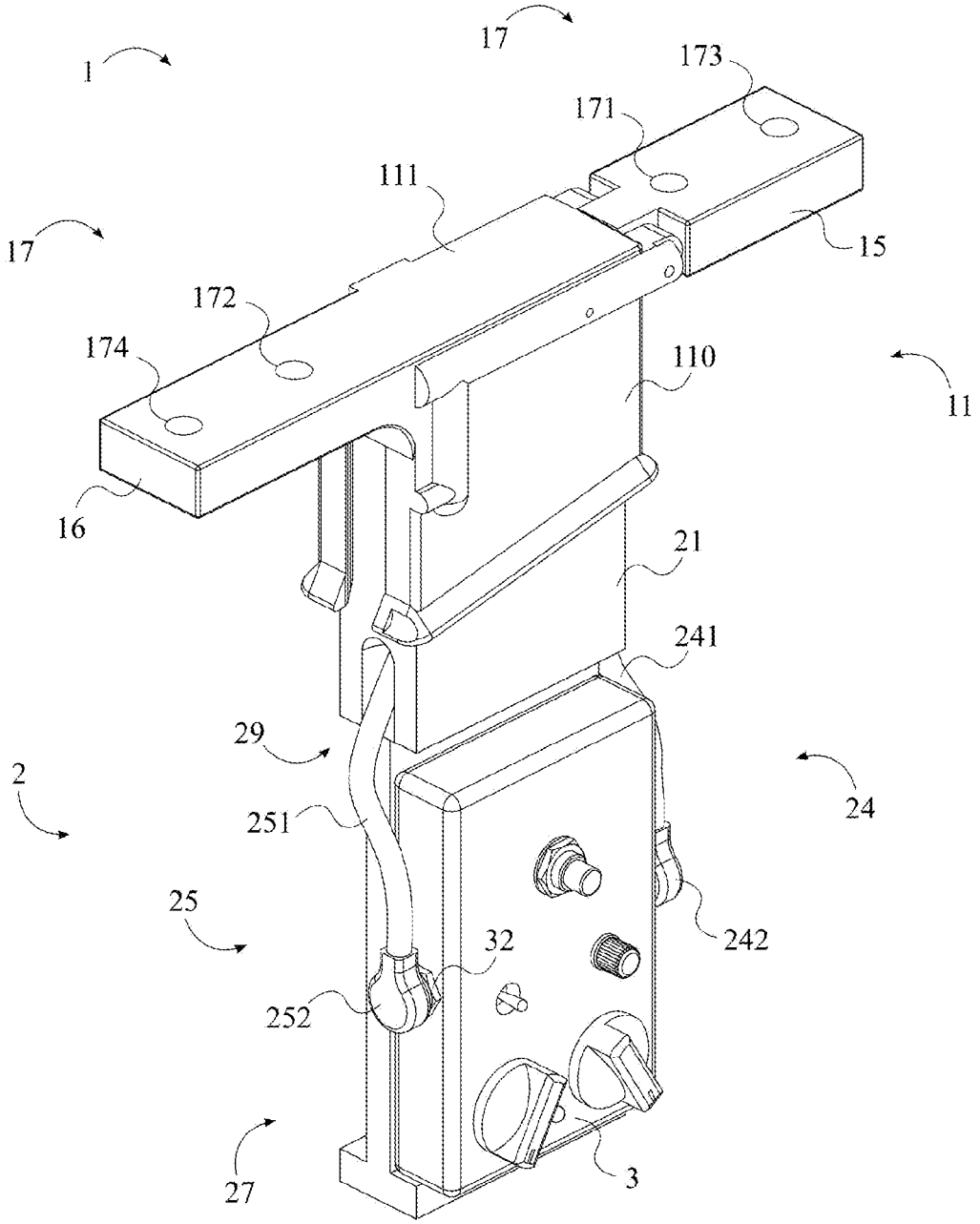
FIG. 7 is a perspective view of the mounting cartridge being positioned into the cartridge receiver, wherein a primary effects pedal is positioned within the first receiving slot of the mounting cartridge.
Figure 8:
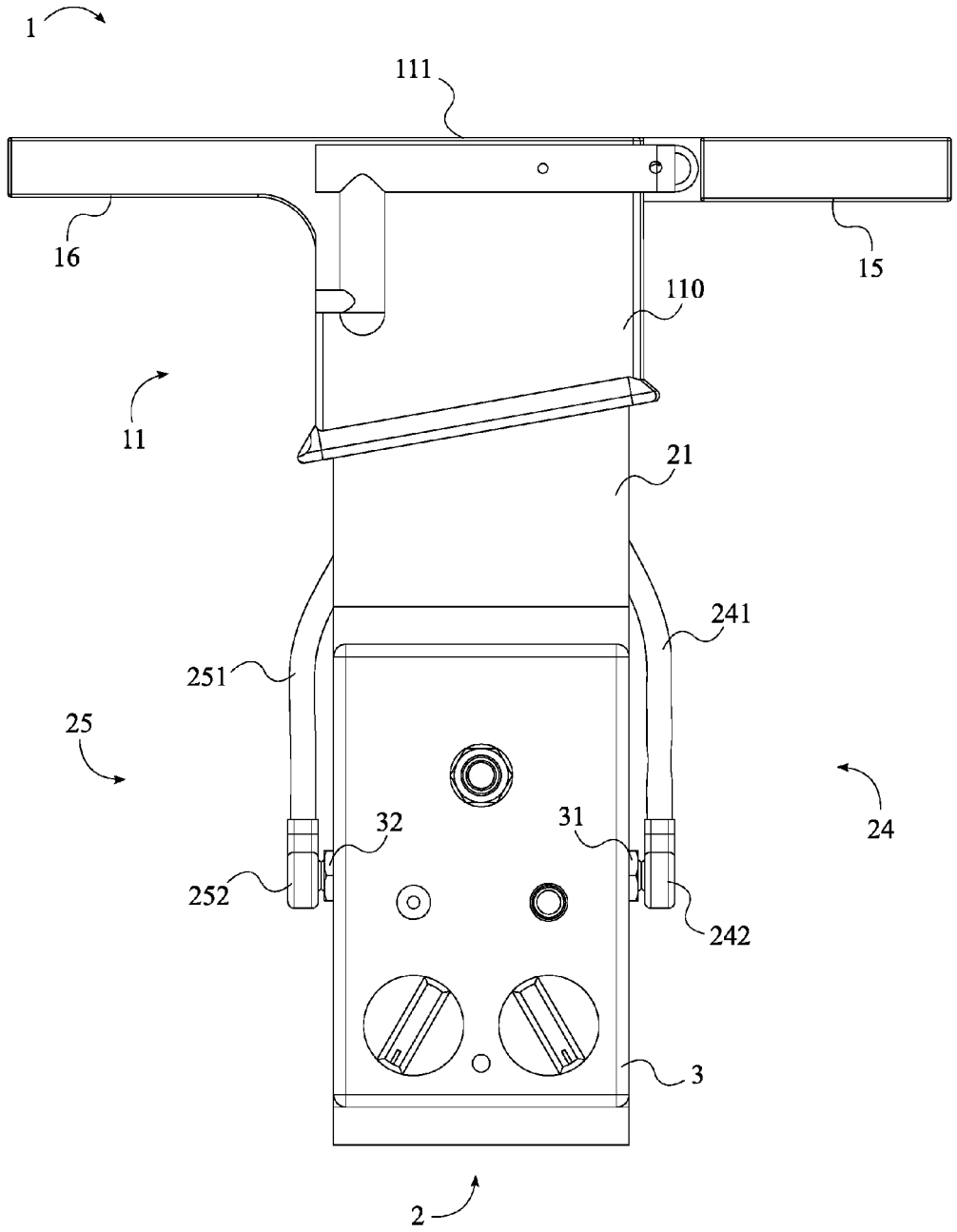
FIG. 8 is a front elevational view of the mounting cartridge positioned into the cartridge receiver, wherein the signal-in pedal connector is positioned into the input port of the primary effects pedal and the signal-out pedal connector is positioned into the output port of the pedal connector.
Figure 11:
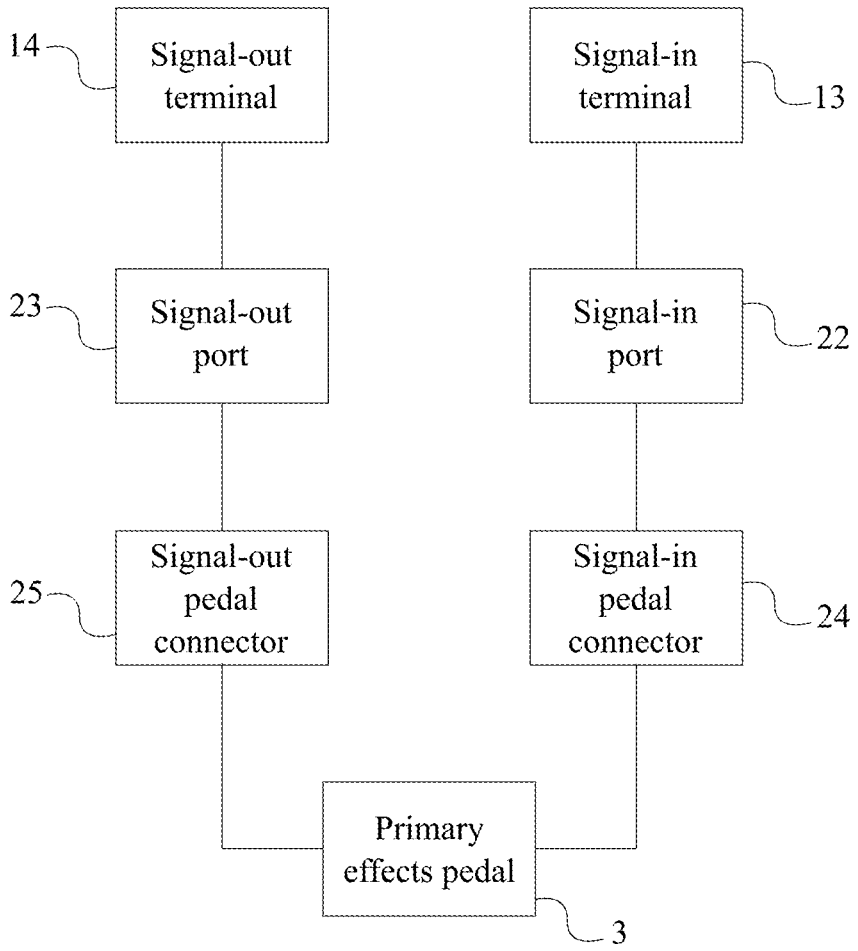
FIG. 11 is an electrical diagram, wherein the primary effects pedal is electrically connected to the signal-in port and the signal-out port via the signal-in pedal connector and the signal-out pedal connector respectively.

In reference to FIG. 7-8, if one effects pedal is to be used, then a primary effects pedal 3 is positioned into the first receiving slot 26; the primary effects pedal 3 comprising an input port 31 and an output port 32. The signal-in pedal connector 24 is positioned into the input port 31, while the signal-out pedal connector 25 is positioned into the output port 32. More specifically, the signal-in jack 242 is positioned into the input port 31, while the signal-out jack 252 is positioned into the output port 32. In this way, the primary effects pedal 3 is electrically connected to the signal-in port 22 through the signal-in pedal connector 24 and electrically connected to the signal-out port 23 through the signal-out pedal connector 25, as depicted in FIG. 11.

Figure 9:
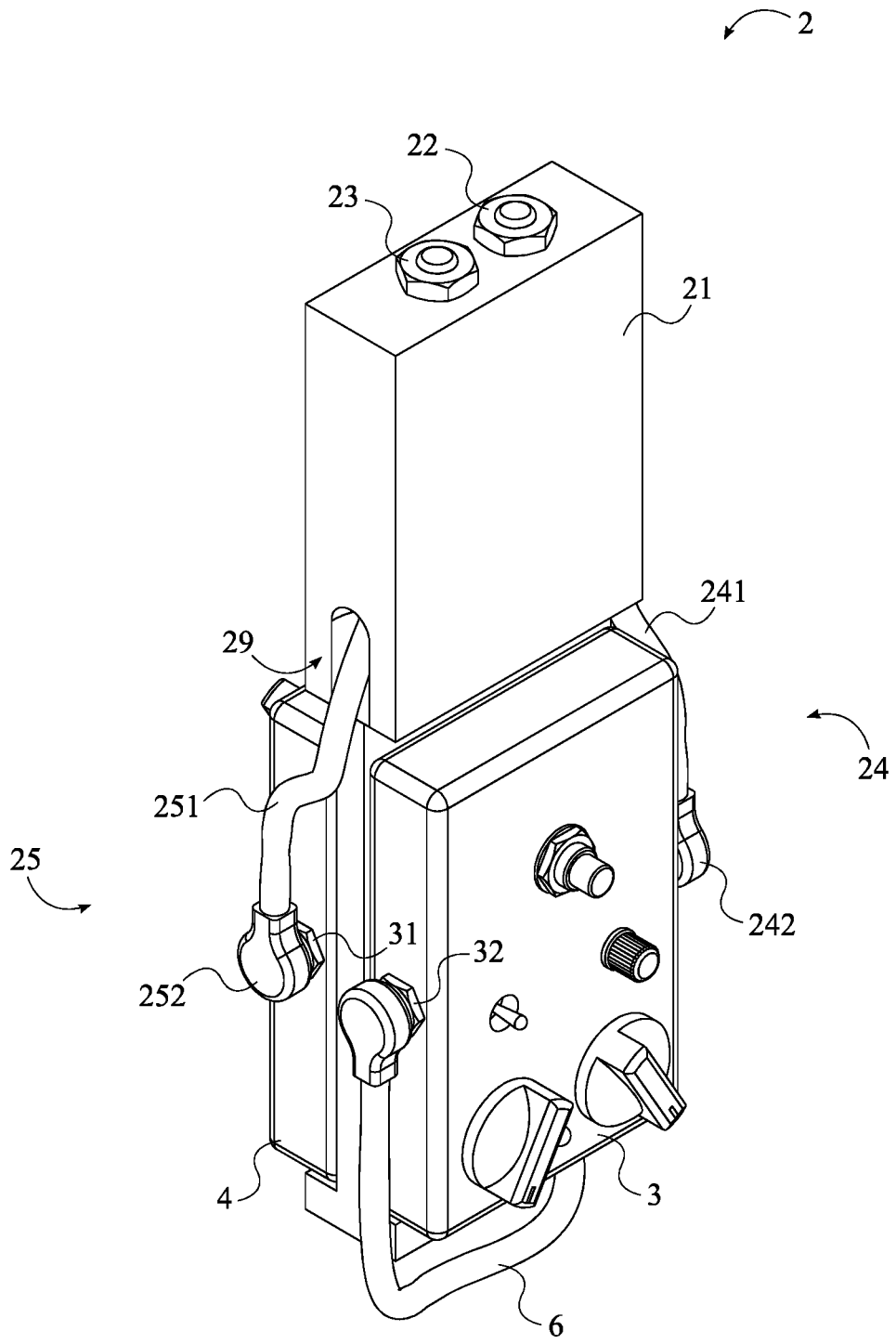
FIG. 9 is a front perspective view of the mounting cartridge, wherein the primary effects pedal and a secondary effects pedal are positioned within the first receiving slot and the second receiving slot respectively and are connected via the bridge cable.
Figure 10:
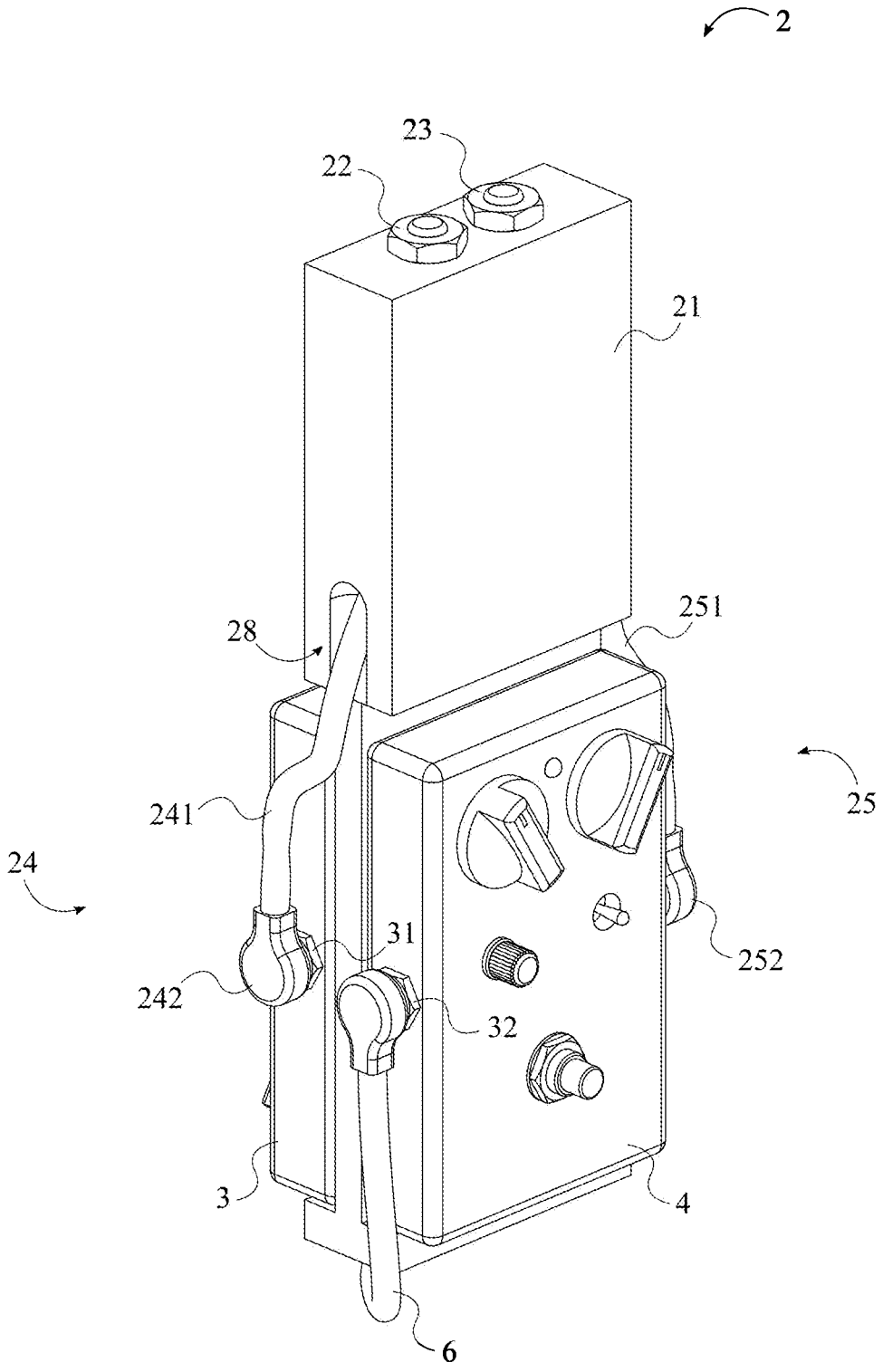
FIG. 10 is a rear perspective view of the mounting cartridge, wherein the primary effects pedal and a secondary effects pedal are positioned within the first receiving slot and the second receiving slot respectively and are connected via the bridge cable.

In reference to FIG. 9-10, if two effects pedals are used, then a bridge cable 6 is used to electronically connect the primary effects pedal 3 and a secondary effects pedal 4 in series. Similar to the primary effects pedal 3, the secondary effects pedal 4 comprises an input port 31 and an output port 32. The primary effects pedal 3 is positioned into the first receiving slot 26, while the secondary effects pedal 4 is positioned into the second receiving slot 27. The signal-in pedal connector 24 and the signal-out pedal connector 25 are then used to secure the primary effects pedal 3 and the secondary effects pedal 4 in place within the first receiving slot 26 and the second receiving slot 27 respectively.

Figure 12:
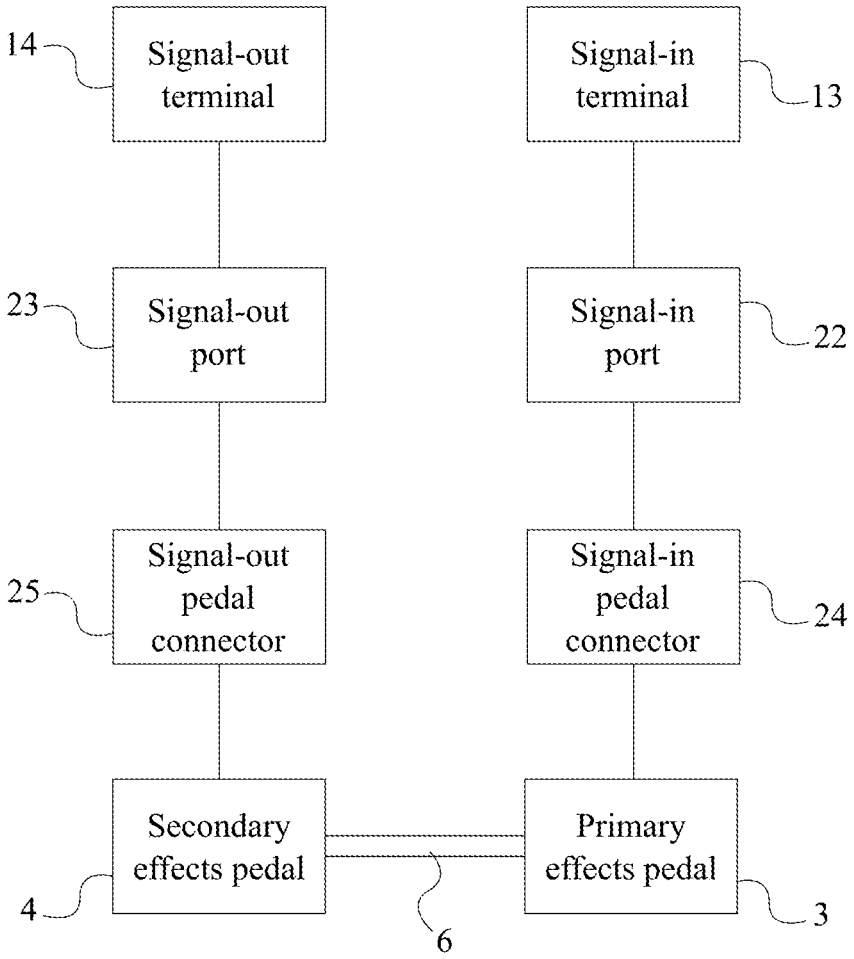
FIG. 12 is an electrical diagram, wherein the primary effects pedal is electrically connected to the signal-in port via the signal-in pedal connector and the secondary effects pedal is electrically connected to the signal-out port via the signal-out pedal connector, and wherein the primary effects pedal is electrically connected to the secondary effects pedal via the bridge cable.

In further reference to FIG. 9-10, the signal-in pedal connector 24 is positioned into the input port 31 of the primary effects pedal 3, while the signal-out pedal connector 25 is positioned into the output port 32 of the secondary effects pedal 4. More specifically, the signal-in jack 242 is positioned into the input port 31 of the primary effects pedal 3 and the signal-out jack 252 is positioned into the output port 32 of the secondary effects pedal 4. The primary effects pedal 3 is electrically connected to the signal-in port 22 through the signal-in pedal connector 24, while the secondary effects pedal 4 is electrically connected to the signal-out port 23 through the signal-out pedal connector 25, as depicted in FIG. 12. The primary effects cartridge and the secondary effects cartridge are connected to each other via the bridge cable 6.

The bridge cable 6 is positioned into the output port 32 of the primary effects pedal 3 and into the input port 31 of the secondary effects pedal 4. The bridge cable 6 comprises a cable body, a first jack, and a second jack, wherein the first jack and the second jack are terminally connected to the cable body and positioned opposite each other along the cable body. The first jack is positioned into the output port 32 of the primary effects pedal 3, while the second jack is positioned into the input port 31 of the secondary effects pedal 4. In turn, the primary effects pedal 3 is electrically connected to the secondary effects pedal 4 through the bridge cable 6, as depicted in FIG. 12.

In reference to FIG. 1 and FIG. 4-5, the mounting cartridge 2 further comprises a first cable slot 28 and a second cable slot 29. The first cable slot 28 and the second cable slot 29 traverse into the cartridge casing 21 and are positioned opposite each other about the cartridge casing 21. While the first receiving slot 26 and the second receiving slot 27 are positioned through the front and back of the cartridge casing 21 respectively, the first cable slot 28 and the second cable slot 29 are positioned through the right side and the left side of the cartridge casing 21. The first cable slot 28 provides clearance through the cartridge casing 21 for the signal-in pedal connector 24, while the second cable slot 29 provides clearance through the cartridge casing 21 for the signal-out pedal connector 25.

The signal-in pedal connector 24 is pivotally positioned through the first cable slot 28, wherein the signal-in cable 241 is able to be pivotally positioned away from the cartridge casing 21 to adjust the position of the signal-in jack 242. Similarly, the signal-out pedal connector 25 is pivotally positioned through the second cable slot 29, wherein the signal-out cable 251 is able to be pivotally positioned away from the cartridge casing 21 to adjust the position of the signal-out jack 252. The ability of the signal-in pedal connector 24 and the signal-out pedal connector 25 to pivot away from the cartridge casing 21 is critical as it allows the signal-in pedal connector 24 and the signal-out pedal connector 25 to be more readily attached to the primary effects pedal 3 and the secondary effects pedal 4 and to be more readily adaptable to effects pedals having different sizes.

Figure 6:
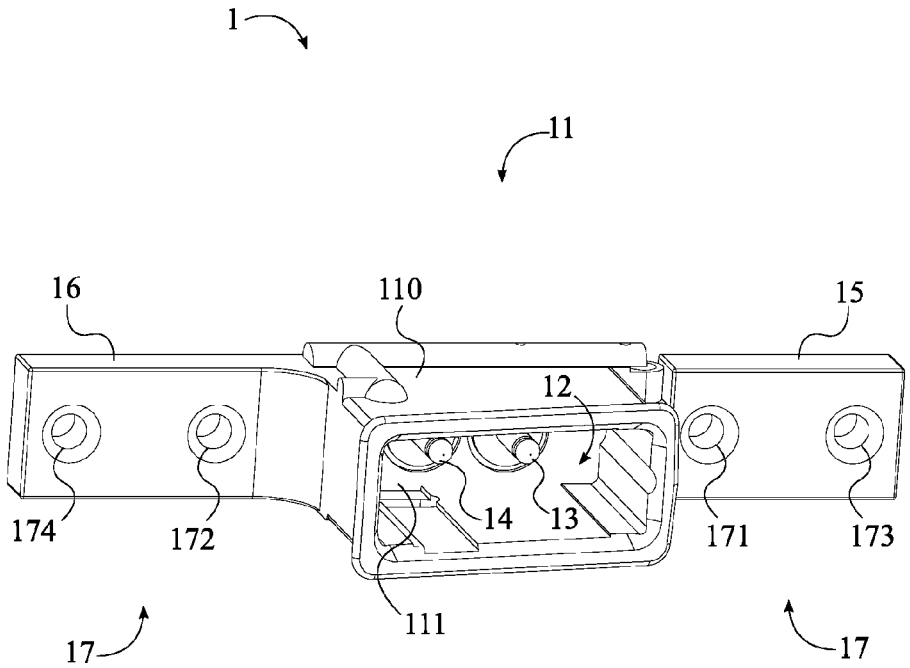
FIG. 6 is a perspective view of the cartridge receiver.

In reference to FIG. 6, the cartridge receiver 1 comprises a receiver body 11, a receiving volume 12, a signal-in terminal 13, a signal-out terminal 14, and a plurality of holes 17. The receiver body 11 is the central structure of the cartridge receiver 1 and defines the general shape of the cartridge receiver 1. The receiving volume 12 traverses into the receiver body 11 and is the empty space into which the mounting cartridge 2 is positioned when the mounting cartridge 2 is attached to the cartridge receiver 1, as depicted in FIG. 7-8. Both the signal-in terminal 13 and the signal-out terminal 14 are connected to the receiver body 11 and positioned adjacent to each other within the receiving volume 12. The cartridge receiver 1 is electronically connected to the mounting cartridge 2 through the signal-in terminal 13 and the signal-out terminal 14.

More specifically, the receiver body 11 comprises a lateral wall 110 and an end plate 111, wherein the lateral wall 110 is perimetrically connected to the end plate 111. Together, the lateral wall 110 and the end plate 111 delineate the receiving volume 12 into which the mounting cartridge 2 is positioned. The signal-in terminal 13 and the signal-out terminal 14 are adjacently connected to the end plate 111, wherein the signal-in terminal 13 and the signal-out terminal 14 extend along the receiving volume 12, away from the end plate 111. Meanwhile, the plurality of holes 17 traverses through the receiver body 11, providing a means of connection between the electric instrument 5 and the cartridge receiver 1.

In the preferred embodiment of the present invention, the receiver body 11 is recessed in the electric instrument 5, such that the profile of the electric instrument 5 is unchanged. A recess matching the profile of the receiver body 11 is hollowed out of the electric instrument 5, such that the receiver body 11 fits snuggly within the electric instrument 5. In order to keep the profile of the receiver body 11 streamlined, the plurality of holes 17 traverses through the end plate 111; more specifically, the plurality of holes 17 comprises a first hole 171 and a second hole 172, wherein the first hole 171 and the second hole 172 traverse through the end plate 111. Once the receiver body 11 is positioned within the electric instrument 5, a screw is positioned through the first hole 171 and the second hole 172 to secure the receiver body 11 to the electric instrument 5. The first hole 171 and the second hole 172 are positioned opposite each other along the end plate 111, wherein the signal-in terminal 13 and the signal-out terminal 14 are positioned in between the first hole 171 and the second hole 172. Such a configuration allows both sides of the receiver body 11 to be securely anchored within the electric instrument 5.

In reference to FIG. 6, in an external embodiment, the receiver body 11 is mounted to the electric instrument 5 externally and comprises a first flange 15 and a second flange 16. The first flange 15 and the second flange 16 are adjacently connected to the lateral wall 110 opposite the receiving volume 12, wherein the first flange 15 and the second flange 16 are positioned opposite each other across the lateral wall 110. The first flange 15 and the second flange 16 provide stability to the receiver body 11, allowing the cartridge receiver 1 to be adjacently connected to the electric instrument 5; the cartridge receiver 1 being securely mounted to the exterior of the electric instrument 5. The plurality of holes 17 traverses through both the first flange 15 and the second flange 16, wherein the cartridge receiver 1 is secured in place via the first flange 15 and the second flange 16.

In further reference to FIG. 6, the first flange 15 and the second flange 16 are positioned on the lateral wall 110 adjacent to the end plate 111. In this way, the first flange 15, the second flange 16, and the end plate 111 rest flush against the surface of the electric instrument 5, while the receiving volume 12 is directed away from the electric instrument 5, such that the mounting cartridge 2 can be attached to the cartridge receiver 1. The first flange 15 and the second flange 16 are positioned opposite each other along the end plate 111 in order to securely hold the cartridge receiver 1 flush against the surface of the electric instrument 5.

In yet further reference to FIG. 6, in the external embodiment, the plurality of holes 17 further comprises a third hole 173 and a fourth hole 174 to further stabilize the connection between the cartridge receiver 1 and the electric instrument 5. The first hole 171 and the third hole 173 traverse through the first flange 15, while the second hole 172 and the fourth hole 174 traverse through the second flange 16. The first hole 171 is positioned adjacent to the lateral wall 110, while the third hole 173 is positioned adjacent to the first hole 171 opposite the lateral wall 110. Similarly, the second hole 172 is positioned adjacent to the lateral wall 110, while the fourth hole 174 is positioned adjacent to the second hole 172 opposite the lateral wall 110. The use of two holes through each of the first flange 15 and the second flange 16 ensures that the cartridge receiver 1 is securely anchored to the electric instrument 5.

Screws are inserted through each of the plurality of holes 17 and threaded into screw holes drilled into the electric instrument 5 in order to connect the cartridge receiver 1 to the electric instrument 5. Alternatively, the screws can be threaded directly into the surface of the electric instrument 5. Additional holes are drilled through the electric instrument 5 adjacent to the receiver body 11 in order to allow electrical wire to be connected to the signal-in terminal 13 and the signal-out terminal 14.

In a compact external embodiment, the receiver body 11 comprises only the first flange 15, while the plurality of holes 17 comprises only the first hole 171 and the second hole 172. The first flange 15 is adjacently connected to the lateral wall 110 opposite the receiving volume 12, wherein the first hole 171 traverses through the first flange 15. Meanwhile, the second hole 172 traverses through the end plate 111 opposite the first flange 15, such that the signal-in terminal 13 and the signal-out terminal 14 are positioned in between the first hole 171 and the second hole 172. The first flange 15 provides increased stability, while the absence of the second flange 16 reduces the profile of the receiver body 11 as the cartridge receiver 1 is mounted externally on the electric instrument 5.

In reference to FIG. 7-8, when the mounting cartridge 2 is attached to the cartridge receiver 1, the top end of the cartridge casing 21 is positioned into the receiving volume 12 of the cartridge receiver 1. As the cartridge casing 21 is inserted into the receiving volume 12, the signal-in terminal 13 engages the signal-in port 22, such that the signal-in terminal 13 is positioned into the signal-in port 22. Similarly, the signal-out terminal 14 engages the signal-out port 23, such that the signal-out terminal 14 is positioned into the signal-out port 23. When the signal-in terminal 13 is positioned into the signal-in port 22, the signal-in terminal 13 is electrically connected to the signal-in port 22 as depicted in FIG. 11-12, thus allowing the electronic signal of the electric instrument 5 to be passed through the signal-in pedal connector 24 and into the primary effects pedal 3. Likewise, when the signal-out terminal 14 is positioned into the signal-out port 23, the signal-out terminal 14 is electrically connected to the signal-out port 23 as depicted in FIG. 11-12, thus allowing the manipulated electronic signal to exit the primary effects pedal 3 or the secondary effects pedal 4 through the signal-out pedal connector 25.

The present invention may further comprise a changeover switch that is used to direct the electronic signal of the electric instrument 5 through the effects cartridge. The changeover switch is connected to the electric instrument 5 such that the changeover switch is accessible to the user. Ideally, the changeover switch is used as a replacement to an existing control of the electric instrument 5. For example, if the universal effects carrier is used in conjunction with an electric guitar, then a tone control of the electric guitar can be removed and replaced with the changeover switch, thus minimizing any alterations to the electric instrument 5 (i.e. drilling additional holes into the instrument body). Of course, it is also possible for the changeover switch to be mounted to any other accessible region of the electric instrument 5.

The changeover switch allows the user to direct the electronic signal produced by the electric instrument 5 from a normal path through the electric instrument 5 to a manipulated path through the mounting cartridge 2 and the attached effects pedal(s). The normal path follows the circuit of the electric instrument 5, while the manipulated path follows the electrical path through the signal-in terminal 13, the signal-in port 22, the signal-in pedal connector 24, the primary effects pedal 3 and/or the secondary effects pedal 4, the signal-out pedal connector 25, the signal-out port 23, and the signal-out terminal 14. As such, the changeover switch is electrically connected to the signal-in terminal 13 in order to operatively couple the changeover switch to the primary effects pedal 3 and/or secondary effects pedal 4 attached to the mounting cartridge 2.

The changeover switch is a push-on/push-off style switch, wherein the changeover switch is used to direct the electronic signal between the normal path and the manipulated path. When the changeover switch is in the off position, the electronic signal is directed along the normal path through the circuit of the electric instrument 5 and is not manipulated. When the changeover switch is in the on position, the electronic signal is directed along the manipulated path through the effects circuit and manipulated in accordance with the configuration of the effects circuit.

The present invention also allows a musician to utilize more than two effects pedals by interchanging the mounting cartridge 2. For example, if the musician has multiple mounting cartridges, each mounting cartridge can be used to support multiple different effects pedals. In this way, the user can remove one mounting cartridge loaded with a first set of effects pedals for a subsequent mounting cartridge loaded with a second set of different effects pedals while playing, thus adding to the creativity and expression of the musician.

Although the invention has been explained in relation to its preferred embodiment, it is to be understood that many other possible modifications and variations can be made without departing from the spirit and scope of the invention as hereinafter claimed.

What is claimed is:

1. A universal effects carrier comprises:

a mounting cartridge;

the mounting cartridge comprises a cartridge casing, a signal-in port, a signal-out port, a signal-in pedal connector, a signal-out pedal connector, and a first receiving slot;

the signal-in port and the signal-out port being positioned through the cartridge casing;

the signal-in port and the signal-out port being connected to the cartridge casing;

the signal-in pedal connector and the signal-out pedal connector being pivotally connected to the cartridge casing;

the signal-in pedal connector being electrically connected to the signal-in port;

the signal-out pedal connector being electrically connected to the signal-out port;

the first receiving slot traversing into the cartridge casing; and the first receiving slot being positioned along the cartridge casing opposite the signal-in port and the signal-out port.

2. The universal effects carrier as claimed in claim 1 comprises:

the mounting cartridge further comprises a first cable slot and a second cable slot;

the first cable slot and the second cable slot traversing into the cartridge casing;

the signal-in pedal connector being pivotally positioned through the first cable slot; and the signal-out pedal connector being pivotally positioned through the second cable slot.

3. The universal effects carrier as claimed in claim 1 comprises:

the signal-in pedal connector and the signal-out pedal connector being positioned opposite each other across the cartridge casing.

4. The universal effects carrier as claimed in claim 1 comprises:

the signal-in pedal connector comprises a signal-in cable and a signal-in jack;

the signal-in cable being pivotally connected to the cartridge casing; and the signal-in jack being terminally connected to the signal-in cable opposite the cartridge casing.

5. The universal effects carrier as claimed in claim 1 comprises:

the signal-out pedal connector comprises a signal-out cable and a signal-out jack;

the signal-out cable being pivotally connected to the cartridge casing; and the signal-out jack being terminally connected to the signal-out cable opposite the cartridge casing.

6. The universal effects carrier as claimed in claim 1 comprises:

a primary effects pedal;

the primary effects pedal comprises an input port and an output port;

the primary effects pedal being positioned within the first receiving slot;

the signal-in pedal connector being positioned into the input port; and the signal-out pedal connector being positioned into the output port.

7. The universal effects carrier as claimed in claim 1 comprises:

a primary effects pedal;

the primary effects pedal being electrically connected to the signal-in port through the signal-in pedal connector; and the primary effects pedal being electrically connected to the signal-out port through the signal-out pedal connector.

8. The universal effects carrier as claimed in claim 1 comprises:

the mounting cartridge further comprises a second receiving slot;

the second receiving slot traversing into the cartridge casing opposite the first receiving slot; and the second receiving slot being positioned along the cartridge casing opposite the signal-in port and the signal-out port.

9. The universal effects carrier as claimed in claim 8 comprises:

a primary effects pedal and a secondary effects pedal;

the primary effects pedal being positioned within the first receiving slot; and the secondary effects pedal being positioned within the second receiving slot.

10. The universal effects carrier as claimed in claim 8 comprises:

a primary effects pedal and a secondary effects pedal;

the signal-in pedal connector being positioned into an input port of the primary effects pedal; and the signal-out pedal connector being positioned into an output port of the secondary effects pedal.

11. The universal effects carrier as claimed in claim 8 comprises:

a primary effects pedal, a secondary effects pedal, and a bridge cable;

the bridge cable being positioned into an output port of the primary effects pedal and an input port of the secondary effects pedal; and the secondary effects pedal being electrically connected to the primary effects pedal through the bridge cable.

12. The universal effects carrier as claimed in claim 8 comprises:

a primary effects pedal and a secondary effects pedal;

the primary effects pedal being electrically connected to the signal-in port through the signal-in pedal connector; and the secondary effects pedal being electrically connected to the signal-out port through the signal-out pedal connector.

* * * * *